US010766051B1

(12) United States Patent
Horton

(10) Patent No.: US 10,766,051 B1
(45) Date of Patent: Sep. 8, 2020

(54) APPARATUSES FOR WETTING MILDEW-REMOVAL STRIPS AND RELATED METHODS

(71) Applicant: Max Lee Horton, Houston, TX (US)

(72) Inventor: Max Lee Horton, Houston, TX (US)

( * ) Notice: Subject to any disclaimer, the term of this patent is extended or adjusted under 35 U.S.C. 154(b) by 0 days.

(21) Appl. No.: 16/532,609

(22) Filed: Aug. 6, 2019

(51) Int. Cl.

| | |
|---|---|
| ***B05C 5/02*** | (2006.01) |
| ***B08B 3/08*** | (2006.01) |
| ***B05C 11/10*** | (2006.01) |
| ***B05C 5/00*** | (2006.01) |
| *B05D 1/26* | (2006.01) |

(52) U.S. Cl.
CPC ..... *B05C 5/0208* (2013.01); *B05C 5/0229* (2013.01); *B05C 5/0241* (2013.01); *B05C 5/002* (2013.01); *B05C 11/1044* (2013.01); *B05D 1/26* (2013.01); *B08B 3/08* (2013.01)

(58) Field of Classification Search
CPC ... B05C 5/0208; B05C 5/0275; B05C 5/0229; B05C 5/0241; B05C 11/1031; B05C 11/1044; B05C 9/10; B05C 11/115; B05C 13/02; B05C 3/125; B65D 47/06; B08B 3/08; Y10S 118/19; B65B 39/00; B67C 11/00; B67C 11/02
USPC ..... 141/236, 237, 239, 243, 244, 246, 255, 141/264, 331–345; 222/485, 484, 479; 118/313, 429
See application file for complete search history.

(56) References Cited

U.S. PATENT DOCUMENTS 532,072 A * 1/1895 Kister
538,941 A * 5/1895 Wolven
3,695,486 A * 10/1972 Warner ..... B65B 3/30 222/162

(Continued)

FOREIGN PATENT DOCUMENTS

| | | |
|---|---|---|
| DE | 102007003376 | * 4/2008 |
| EP | 1588764 | * 10/2005 |
| FR | 992473 | * 5/1949 |

OTHER PUBLICATIONS

"How to Remove Mold and Grout from your Bathroom Tiles and Keep it From Coming Back" Service Master DSI—Minneapolis, Jun. 30, 2015, Accessed from the Internet URL <https://www.smdsi-minnesota.com/blog/how-to-remove-mold-and-grout-from-your-bathroom-tiles-and-keep-it-from-coming-back/>.

(Continued)

*Primary Examiner* — Laura Edwards
(74) *Attorney, Agent, or Firm* — Norton Rose Fulbright US LLP

(57) ABSTRACT

An apparatus for wetting one or more absorbent strips with a solution can comprise a solution tray and a dispenser tray, each comprising a base that defines opposing upper and lower surfaces and one or more openings and a sidewall extending away from the upper surface and disposed along a periphery of the base. One or more dispensers can each include a tube extending between first and second ends, the first end being coupled to the dispenser tray's base such that the tube is configured to receive solution from a respective one of the opening(s) of the dispenser tray. An applicator tray can be configured to receive the strip(s). The solution, dispenser, and applicator trays are positionable to permit solution to flow through the solution tray's opening(s) onto the dispenser tray's base, through the dispenser tray's open- (Continued)

ing(s) into the dispenser(s), and through the dispenser(s) onto the applicator tray.

11 Claims, 8 Drawing Sheets

(56) References Cited

U.S. PATENT DOCUMENTS

| | | | | | |
|---|---|---|---|---|---|
| 3,987,824 | A * | 10/1976 | Zehnder | F25C 5/00 | 141/99 |
| 4,518,082 | A * | 5/1985 | Ye | B65D 81/3222 | 206/0.5 |
| 5,829,476 | A * | 11/1998 | Kaneko | B65B 3/326 | 137/606 |
| 2005/0035983 | A1 * | 2/2005 | Cruchon-Dupeyrat | B82Y 10/00 | 346/140.1 |
| 2010/0155500 | A1 * | 6/2010 | Zaccheo | A47G 21/188 | 239/33 |

OTHER PUBLICATIONS

"How to Remove Mold from Grout" Service Master Clean, Aug. 18, 2016. Accessed from the Internet URL <https://www.servicemasterclean.com/blog/residential-clean/how-to-remove-mold-from-grout/>.

Fagan, Katelyn, "How to Get Rid of Black Mold in Your Shower Caulking" What's Up Fagans, Jul. 7, 2017. Accessed from the Internet URL <https://www.whatsupfagans.com/remove-mold-caulking-shower>.

* cited by examiner

APPARATUSES FOR WETTING MILDEW-REMOVAL STRIPS AND RELATED METHODS

FIELD OF INVENTION

The present invention relates generally to apparatuses and methods for wetting absorbent strips with a solution for removing mildew stains on grout and caulk.

BACKGROUND

Mildew can be a problem in damp areas, such as bathroom tub and shower areas. Mildew stains frequently appear on caulk and grout lines in bathrooms. These mildew stains are unsightly and may release mold spores into the air that can create an unpleasant smell. General purpose cleaning products may be ineffective at removing these mildew stains.

Some commercial products, such as TILEX® Mold and Mildew Remover, are marketed for bathroom mildew removal. These commercial products typically contain bleach (sodium hypochlorite) to facilitate mildew removal and are dispensed using a spray bottle. When spraying a bleach solution to treat the mildew-affected area (e.g., a narrow line of caulk or grout), a relatively large amount of overspray typically is dispensed onto surrounding areas, such as tile, that are not affected by mildew. This overspray can waste a large amount of the bleach solution. The wasted bleach solution, when rinsed down the drain, may harm the environment and water supplies. Sprayed bleach solution can evaporate quickly when exposed to air, which can produce irritating bleach fumes and require one or more reapplications of spray. Additionally, these commercial products may require scrubbing of the mildew-affected area to remove the mildew.

The article "How to Get Rid of Black Mold in Your Shower Caulking" by Katelyn Fagan discloses an alternative way to dispense a mildew-removing solution. Lengths of commercially-available cotton coil can be immersed in a bowl of bleach solution and thereafter pressed against mildew-affected sections of caulk or grout. Surface tension can keep the wetted cotton coils removably attached to the grout or caulk line. Use of the wetted cotton coils can eliminate the overspray problem caused by spray bottles. In addition, the cotton coils can keep the grout or caulk wetted with bleach solution for a greater duration than is possible with a single-spray application of bleach solution. Although the cotton coil method generally consumes less bleach solution than the spray bottle method, the cotton coil method can still generate a significant amount of waste. Commercially-available cotton coils are typically large in diameter relative to narrow grout lines and thus may absorb more bleach solution than is necessary to treat the mildew-affected area. And to permit coil immersion in the bowl of bleach solution, the bowl typically must contain more bleach solution than is necessary for the treatment, which can further leave wasted solution.

SUMMARY

The present apparatuses can be configured to wet one or more absorbent strips with a mildew-removing solution, such as bleach, in a manner that creates less waste than conventional bowl-soaking techniques. These absorbent strip(s) can be sized to cover lengths of narrow grout and/or caulk lines while being narrower—and thus requiring less solution to be wetted—than the cotton coils used in conventional treatments. Some apparatuses can include a solution tray, a dispenser tray, and an applicator tray and at least some of the apparatus components—such as those trays—can be detachable, allowing the apparatus to be easily disassembled for storage and re-assembled for use. One or more absorbent strips can be placed on the applicator tray and a packet of mildew-removing solution—which can contain a pre-measured quantity of mildew removing solution that is sufficient but does not significantly exceed the volume required to wet the absorbent strips and treat the mildew-affected area—can be placed onto the solution tray. The mildew-removing solution can be released from the packet (e.g., by piercing the packet). The dispenser tray can be positioned below the solution tray and above the applicator tray such that the dispenser tray can receive the released solution from the solution tray and dispense it onto the absorbent strip(s) disposed on the applicator tray via one or more dispensers. Each of the dispenser(s) can include a tube and a flow restrictor such that the solution can be dispensed onto the strip(s) in a controlled manner. In the manner, the absorbent strip(s) can be wetted using less mildew-removing solution to treat a section of moldy grout or caulk than that typically used when employing conventional mildew removal spay bottles and cotton coils.

The wetted absorbent strip(s) can be removed from the dispenser and applied to grout and/or caulk lines. Once applied to the grout and/or caulk lines, each of the wetted absorbent strip(s) can remain in contact with the grout or caulk during treatment through surface tension. By remaining in contact with the grout or caulk, the absorbent strip can reduce the rate at which the mildew-removing solution evaporates and keep the treated area wetted with solution for a longer duration. By treating the affected area for a longer duration, the need to manually scrub the area can be reduced or eliminated.

Some of the present apparatuses comprise a dispenser tray. In some apparatuses, the dispenser tray comprises a base that defines opposing upper and lower surfaces and one or more openings. In some apparatuses, the dispenser tray comprises a sidewall that extends away from the upper surface and is disposed along a periphery of the base. The dispenser tray in some apparatuses has a length measured in a first direction and a width measured in a second direction that is perpendicular to the first direction that is less than or equal to 30% of the length.

In some apparatuses, the dispenser tray comprises one or more dispensers. In some apparatuses, the dispenser tray comprises four or more dispensers. In some apparatuses, the dispenser comprises a tube extending between first and second ends. In some apparatuses, the first end is coupled to the base of the dispenser tray such that the tube is configured to receive solution from a respective one of the opening(s) of the dispenser tray. In some apparatuses, the dispenser comprises a flow restrictor coupled to the second end of the tube and defining an outlet of the dispenser. In some apparatuses, the flow restrictor has a maximum internal transverse dimension that is less than or equal to 90% of a maximum internal transverse dimension of the tube. In some apparatuses, the flow restrictor has a maximum internal transverse dimension that is less than or equal to 40% of a maximum internal transverse dimension of the tube. In some apparatuses, a maximum internal transverse dimension of the flow restrictor is less than or equal to 0.10 inches.

Some of the present apparatuses comprise an applicator tray that is configured to receive one or more absorbent strips. In some apparatuses, the applicator tray comprises two or more platforms. In some apparatuses, the two or more platforms include one or more upper platforms and one or more lower platforms that are positioned lower than each of the upper platform(s). The dispenser tray and applicator tray, in some apparatuses, are positionable such that when the dispenser tray receives the solution, the solution is permitted to flow through the opening(s) of the dispenser tray into the dispenser(s) and through the dispenser(s) onto the applicator tray. In some apparatuses, the dispensers are positioned in two or more sets of two or more dispensers, each of the sets configured to overlie a respective one of the platforms. In some embodiments, for each of the sets of dispensers, at least two of the dispensers are separated by a distance, measured in the first direction, that is greater than or equal to 50% of the length of the dispenser tray.

Some of the present apparatuses comprise a solution tray. In some apparatuses, the solution tray comprises a base that defines opposing upper and lower surfaces and one or more openings. In some apparatuses, the solution tray comprises a sidewall that extends away from the upper surface and is disposed along a periphery of the base. The solution tray and the dispenser tray, in some apparatuses, are positionable such that when the solution tray receives the solution, the solution is permitted to flow through the opening(s) of the solution tray onto the base of the dispenser tray.

In some apparatuses, the solution tray comprises a lid. The lid in some apparatuses is movable between an open position and a closed position in which the lid overlies at least a majority of the base of the solution tray. In some apparatuses, the lid comprises one or more spikes configured to puncture a packet that is disposed on the solution tray when the lid is moved to the closed position.

In some apparatuses, each of the solution tray, the dispenser tray, and the applicator tray has a length measured in a first direction and a width measured in a second direction that is perpendicular to the first direction. In some apparatuses, for each of the dispenser tray and the applicator tray, the width of the tray is less than or equal to 30% of the length of the tray. In some apparatuses, the length of the solution tray is less than or equal to 50% of each of the lengths of the dispenser tray and the applicator tray.

Some of the present apparatuses comprise one or more dispenser rails. In some apparatuses, the dispenser rails are slidable to an open position in which solution is permitted to flow from the dispenser(s) onto the applicator tray. In some apparatuses, the dispenser rails are slidable to an open position in which solution is permitted to flow from the dispensers of the set onto one of the platforms of the applicator tray. In some apparatuses, the dispenser rails are slidable to a closed position in which solution is not permitted to flow from the dispenser(s) onto the applicator tray. In some apparatuses, the dispenser rails are slidable to a closed position in which solution is not permitted to flow from the dispensers of the set onto one of the platforms of the applicator tray. The dispenser rails in some apparatuses comprise one or more plugs positioned such that, when the dispenser rail is in the closed position, each of the plugs engages a respective one of the flow restrictor(s) to seal the outlet defined by the flow restrictor. The dispenser rails in some apparatuses comprise one or more openings positioned such that, when the dispenser rail is in the open position, for each of the opening(s) solution from a respective one of the dispenser(s) is permitted to pass through the opening.

In some apparatuses, each of the sets of dispensers comprises a rail support. The rail support in some apparatuses is coupled to dispensers of the set. The rail support in some apparatuses defines a guide that is disposed below the flow restrictors of the set and is configured to receive a respective one of the dispenser rails.

Some of the present apparatuses comprise first and second support frames. In some apparatuses, the dispenser tray and the applicator tray are configured to extend between and be removably coupled to the support frames such that the dispenser(s) overlie the applicator tray. In some apparatuses, the solution tray is not configured to extend between the support frames when the dispenser tray and the applicator tray extend between the support frames. The applicator tray in some apparatuses is configured to be pivotably coupled to the second support frame. In some apparatuses, the applicator tray is pivotable to a first position in which at least a majority of the dispenser(s) do not overlie the applicator tray. In some apparatuses, the applicator tray is pivotable to a second position in which the dispenser(s) overlie the applicator tray and the applicator tray.

Some of the present methods of wetting one or more absorbent strips with a solution comprise placing one or more absorbent strips onto an applicator tray. Some of the present methods comprise disposing the solution on a solution tray such that the solution flows through one or more openings defined by the solution tray onto a base of the dispenser tray and through two or more openings defined by the base of the dispenser tray into two or more dispensers. In some methods, each of the dispensers includes a tube coupled to the base of the dispenser tray. Some of the present methods comprise sliding one or more dispenser rails from a closed position in which the dispenser rail(s) do not permit fluid to flow from the dispensers onto the applicator tray to an open position such that the solution exits the dispensers and flows onto the absorbent strip(s).

In some methods, disposing the solution on a solution tray comprises disposing a packet that contains the solution onto the solution tray. Disposing the solution on a solution tray in some methods comprises puncturing the packet.

In some methods, the tube extends between first and second ends. In some methods, the first end is coupled to the base of the dispenser tray. In some methods, the dispenser comprises a flow restrictor coupled to the second end of the tube and defining an outlet of the dispenser. In some methods, the flow restrictor has a maximum internal transverse dimension that is less than or equal to 40% of a maximum internal transverse dimension of the tube.

In some methods, each of the solution tray, the dispenser tray, and the applicator tray has a length measured in a first direction and a width measured in a second direction that is perpendicular to the first direction. In some methods, for each of the dispenser tray and the applicator tray, the width of the tray is less than or equal to 30% of the length of the tray. In some methods, the length of the solution tray is less than or equal to 50% of each of the lengths of the dispenser tray and the applicator tray.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified—and includes what is specified; e.g., substantially 90 degrees includes 90 degrees and substantially parallel includes parallel—as understood by a person of ordinary skill in the art. In any disclosed embodiment, the term "substantially" or "approximately" may be substituted with "within [a percentage] of" what is specified, where the percentage includes 0.1, 1, 5, and 10 percent.

The terms "comprise" and any form thereof such as "comprises" and "comprising," "have" and any form thereof such as "has" and "having," and "include" and any form thereof such as "includes" and "including" are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Further, a device or system that is configured in a certain way is configured in at least that way, but it can also be configured in other ways than those specifically described.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. Views in the figures are drawn to scale, unless otherwise noted, meaning the sizes of the depicted elements are accurate relative to each other for at least the embodiment in the view.

DETAILED DESCRIPTION

Figure 1A:
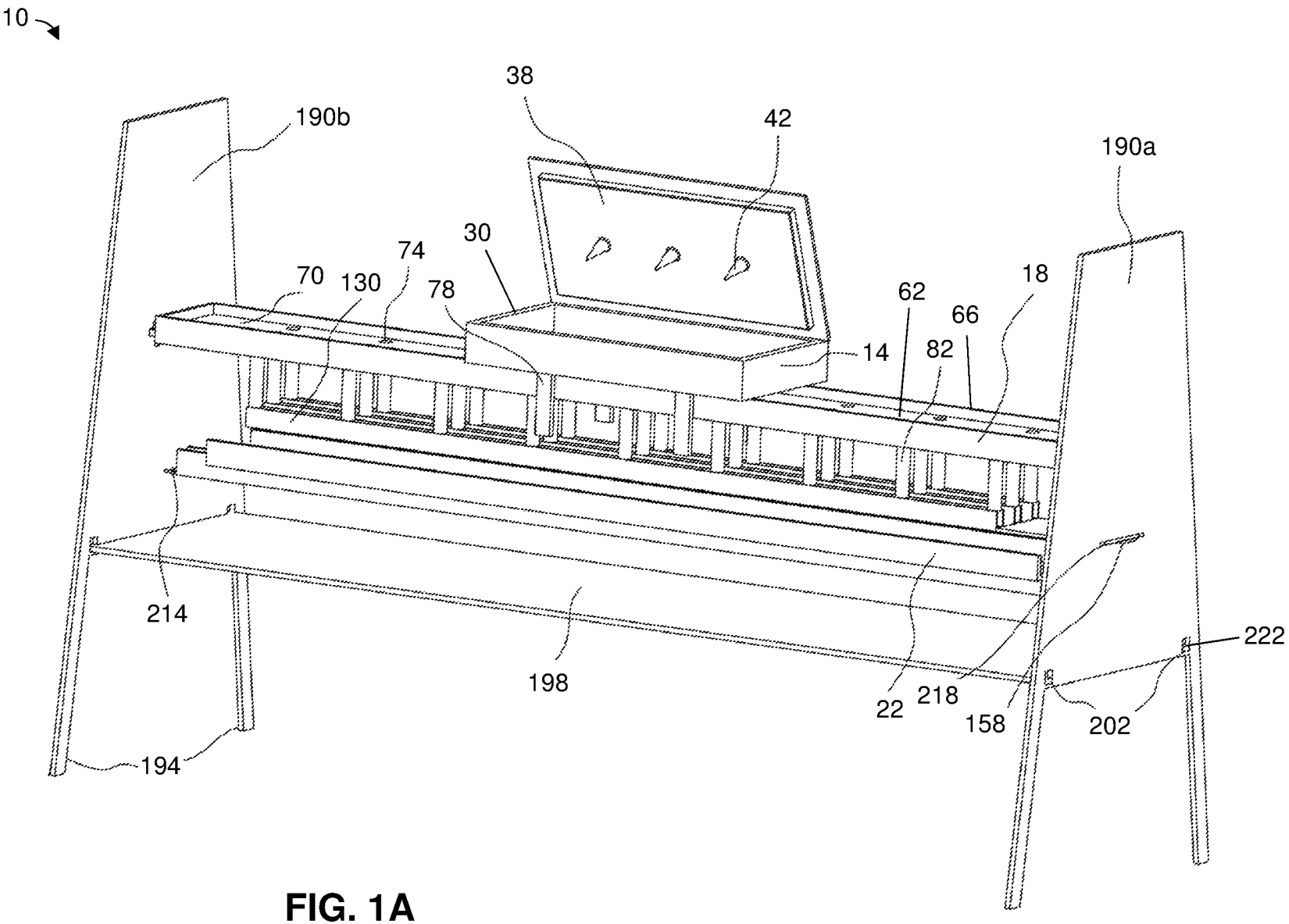
FIG. 1A is a perspective view of one of the present apparatuses configured to wet one or more absorbent strips; the depicted apparatus includes a solution tray, a dispenser tray, and an applicator tray.
Figure 1B:
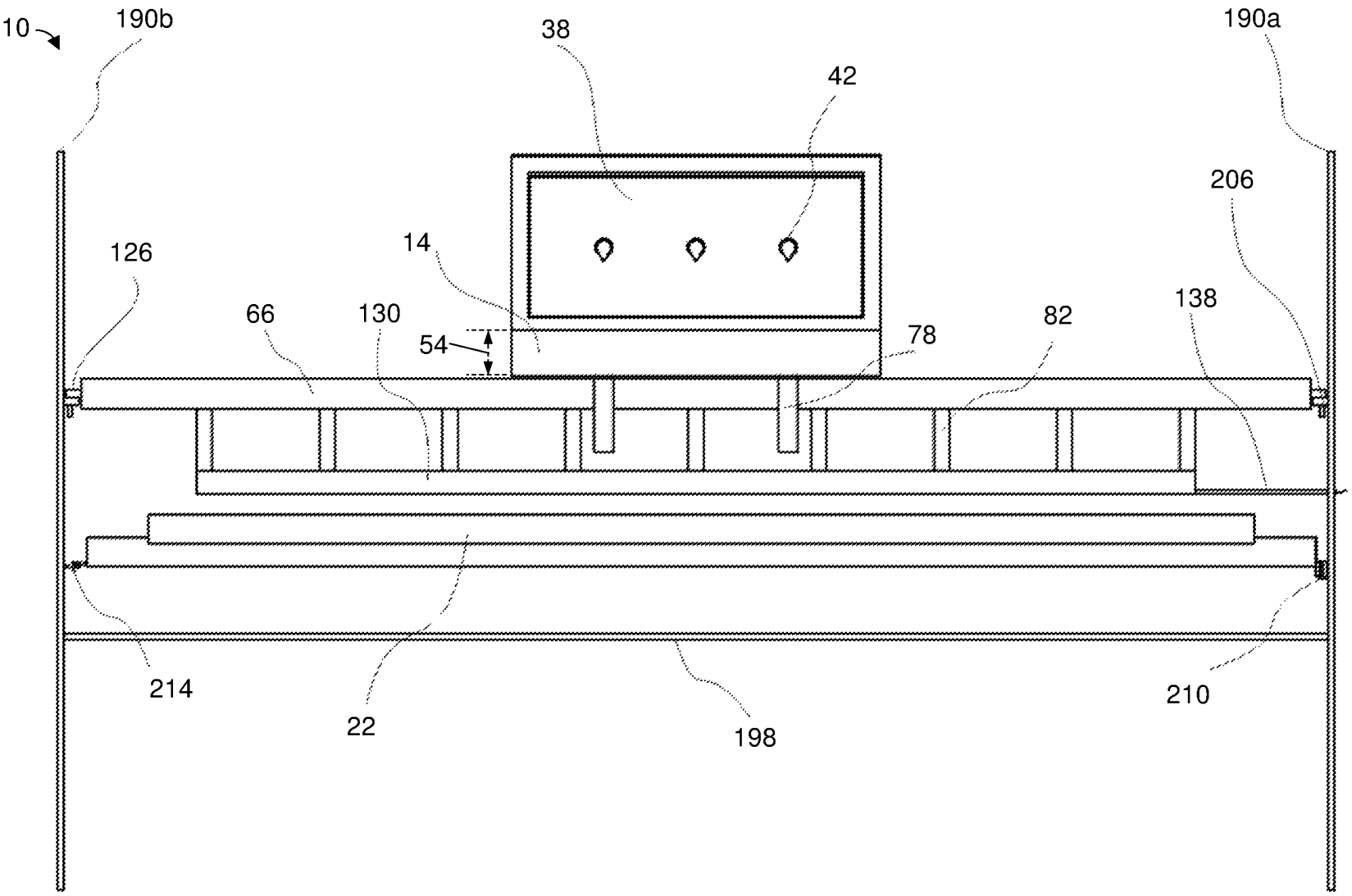
FIG. 1B is a front view of the apparatus of FIG. 1A.

Referring to FIGS. 1A and 1B, shown is an apparatus 10 that can be used to wet one or more absorbent strips with a solution (e.g., such that the wetted strip(s) can be placed on a mildew-affected area to remove mildew therefrom). Apparatus 10 can include a solution tray 14, a dispenser tray 18, and an applicator tray 22. Solution tray 14 can be configured to receive a solution and—as described in further detail below—dispenser tray 18 can be positioned to receive the solution from the solution tray and convey the solution onto applicator tray 22 in a controlled manner such that waste is mitigated. For example, solution tray 14, dispenser tray 18, and applicator tray 22 can be positioned such that the dispenser tray is disposed below the solution tray and above the applicator tray, thereby allowing the solution to flow from the solution tray to the dispenser and applicator trays under the influence of gravity. Applicator tray 22 can be configured to receive the absorbent strip(s) such that solution conveyed by dispenser tray 18 can wet the absorbent strip(s) disposed thereon.

Figure 2A:
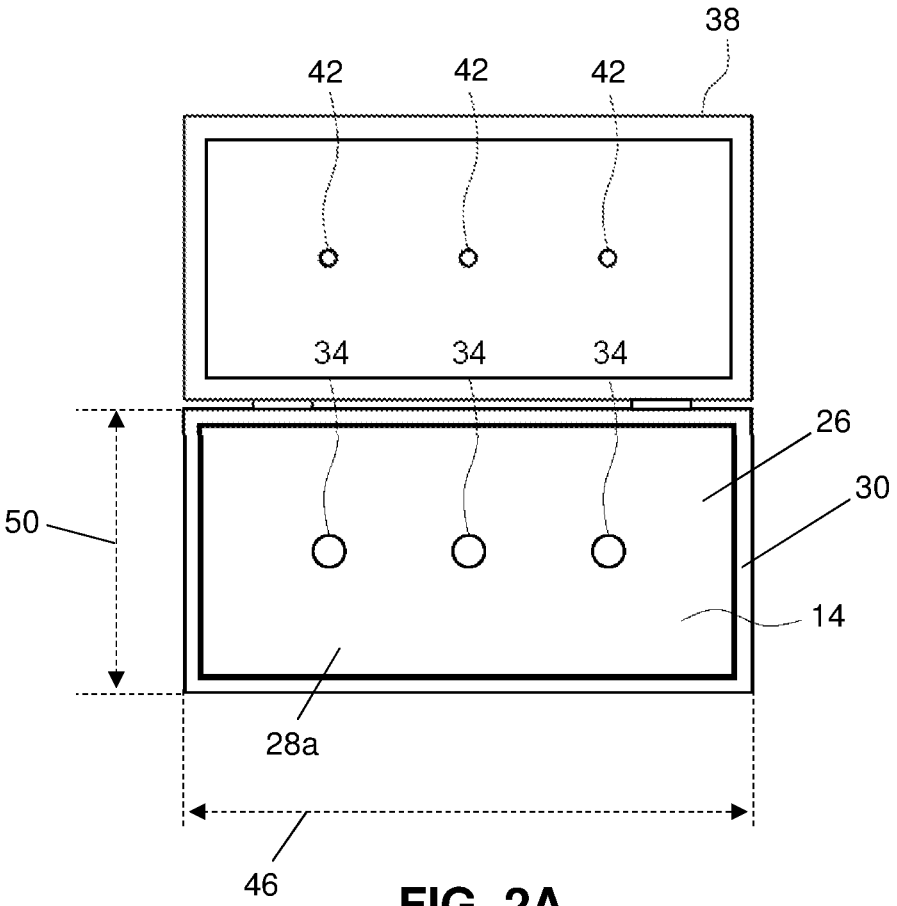
FIG. 2A is a top view of the solution tray of the apparatus of FIG. 1A when the lid of the solution tray is in the open position.
Figure 2B:
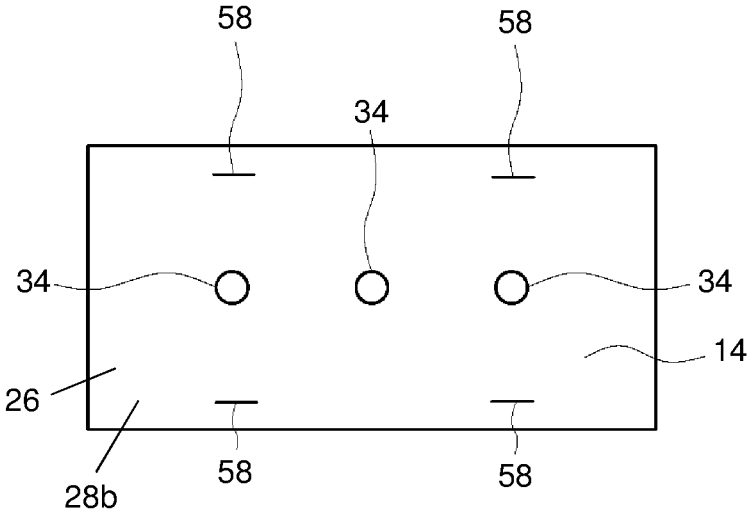
FIG. 2B is a bottom view of the solution tray of FIG. 2A.

FIGS. 2A and 2B show solution tray 14 of apparatus 10. As shown, solution tray 14 can comprise a base 26 defining opposing upper and lower surfaces 28*a* and 28*b* and a sidewall 30 that extends away from the upper surface and surrounds the base's periphery to define a cavity such that the sidewall can (at least temporarily) contain solution received by the solution tray. Solution tray 14 can have any suitable shape and size to accommodate an adequate volume of solution to wet the absorbent strip(s). For example, solution tray 14 can be shaped and sized such that its cavity can receive a packet containing the solution; the use of a packet may allow greater precision with respect to the amount of solution introduced into the absorbent strip(s), compared to pouring solution directly into the solution tray's cavity, which can mitigate waste. To illustrate, solution tray 14 can, but need not, be rectangular; in other embodiments, however, the solution tray can have any shape suitable for accommodating a packet, such as triangular, square, or otherwise polygonal (whether having sharp and/or rounded corners), circular, elliptical, or otherwise rounded, or an irregular shape. In a preferred embodiment, solution tray 14 has a length 46, measured in a first direction, that is greater than or equal to any one of, or between any two of, 3, 4, 5, 6, 7, or 9 inches (e.g., between 5 and 7 inches, or approximately 6 inches), a width 50, measured in a second direction that is perpendicular to the first direction, that is greater than or equal to any one of, or between any two of, 1.0, 1.5, 2.0, 2.5, 3.0, 3.5, 4.0, 4.5, 5.0, or 5.5 inches (e.g., between 2.5 and 3.5 inches, or approximately 3 inches), and a depth 54, measured perpendicularly to each of the length and width, that is greater than or equal to any one of, or between any two of, 0.30, 0.40, 0.50, 0.60, 0.70, 0.80, 0.90, 1.0, or 1.1 inches (e.g., between 0.65 and 0.85 inches, or approximately 0.75 inches).

To allow solution to flow onto dispenser tray 18, base 26 of solution tray 14 can define one or more openings 34, such as greater than or equal to any one of, or between any two of, 1, 2, 3, 4, 5, 6, 7, or 8 openings; as shown, the base defines three openings. In this manner, solution received by solution tray 14 is permitted to flow through opening(s) 34 onto dispenser tray 18. In some embodiments, base 26 of solution tray 14 can be sloped toward opening(s) 34 to facilitate this flow.

Figure 7:
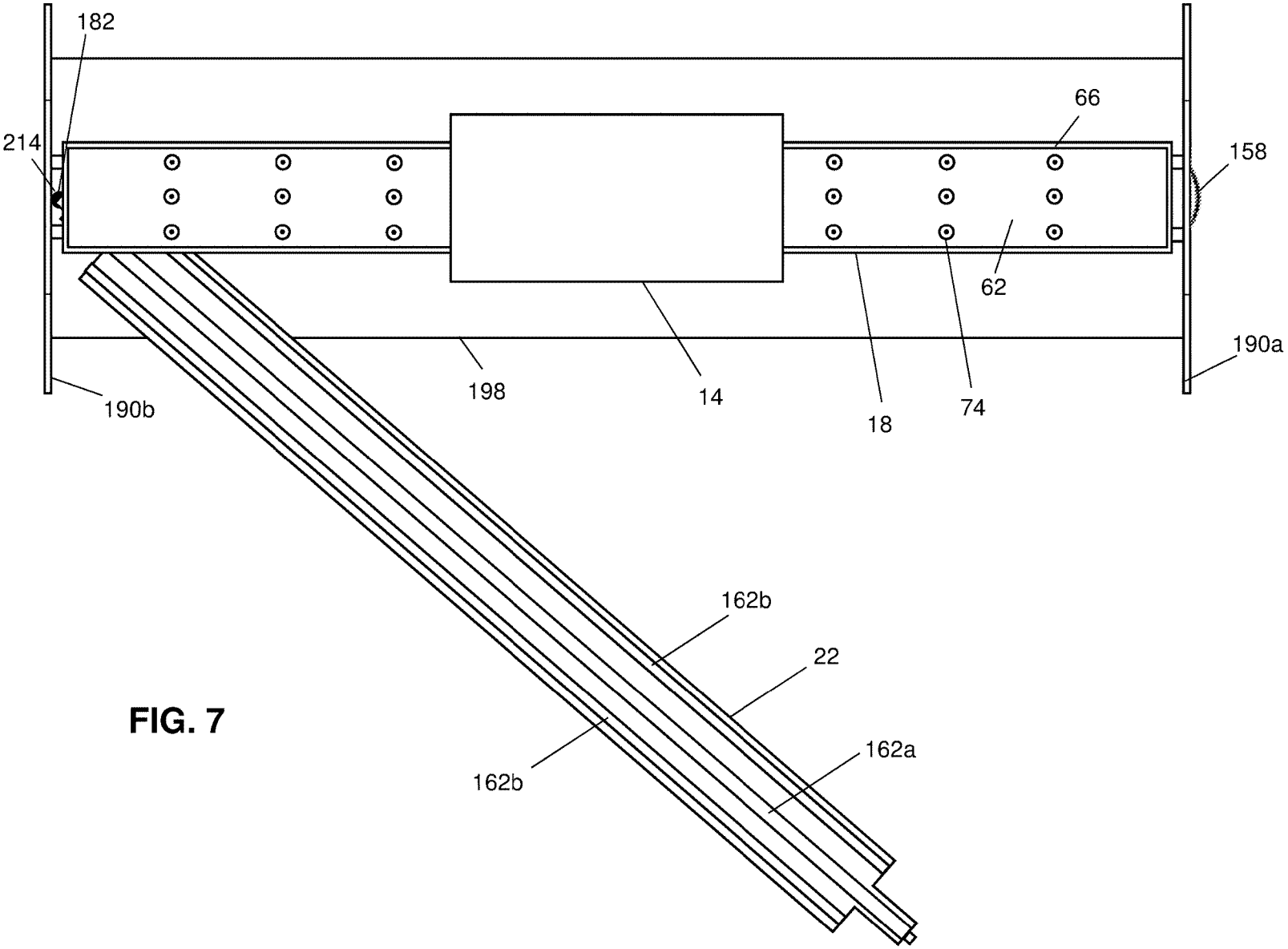
FIG. 7 is a top view of the apparatus of FIG. 1A when the applicator tray is pivoted to a position in which one or more absorbent strips can be disposed on the applicator tray.

Solution tray 14 can comprise a lid 38 that is movable between an open position (FIG. 2A) and a closed position in which the lid overlies at least a majority (up to and including all) of base 26 of the solution tray (FIG. 7). Lid 38 can have substantially the same length and width as solution tray 14 and, optionally, has one or more walls around its perimeter such that, when the lid is in the closed position, the lid's wall(s) are disposed within the cavity defined by the solution tray. In a preferred embodiment, lid 38 has a thickness that is greater than or equal to any one of, or between any two of, 0.20, 0.30, 0.40, 0.50, 0.60, 0.70, 0.80, or 0.90 inches (e.g., between 0.40 and 0.60 inches, or approximately 0.50 inches). Lid 38 can be attached to solution tray 14 in any suitable manner, such as with a hinge.

Lid 38 can be configured to release solution from a packet disposed on solution tray 14. For example, lid 38 can comprise one or more spikes 42 protruding outwardly from an interior surface of the lid. A packet can be placed on solution tray 14 when lid 38 is opened, and when the lid is closed, spike(s) 42 can puncture the packet such that solution drains from the packet into the solution tray and/or through opening(s) 34. Spike(s) 42 can be positioned such that the spike(s) are configured to puncture the top and, preferably, bottom portions of the packet. To illustrate, lid 38 can comprise a spike 42 for each of opening(s) 34, the spike(s) being positioned such that when the lid is in the closed position each of the spike(s) extends through a respective one of the opening(s). To do so, each of spike(s) 42 can have a length that is larger than depth 54 of solution tray 14; for example, each of the spike(s) can have a length that is greater than or equal to any one of, or between any two of, 1.0, 1.1, 1.2, 1.3, 1.4, 1.5, 1.6, 1.7, 1.8, 1.9, or 2.0 inches (e.g., between 1.3 and 1.7 inches, or approximately 1.5 inches). Puncturing the packet at each of opening(s) 34 can facilitate the flow of solution through the opening(s).

As shown in FIG. 2B, solution tray 14 can comprise one or more braces 58, such as greater than or equal to any one of or between any two of 1, 2, 3, 4, 5, 6, 7, 8, or more braces (e.g., four or more braces). Each of brace(s) 58 can protrude away from a lower surface of base 26 of solution tray 14. As described below, solution tray 14 can be coupled to dispenser tray 18 via brace(s) 58, which can facilitate proper alignment between the solution and dispenser trays.

Figure 3A:
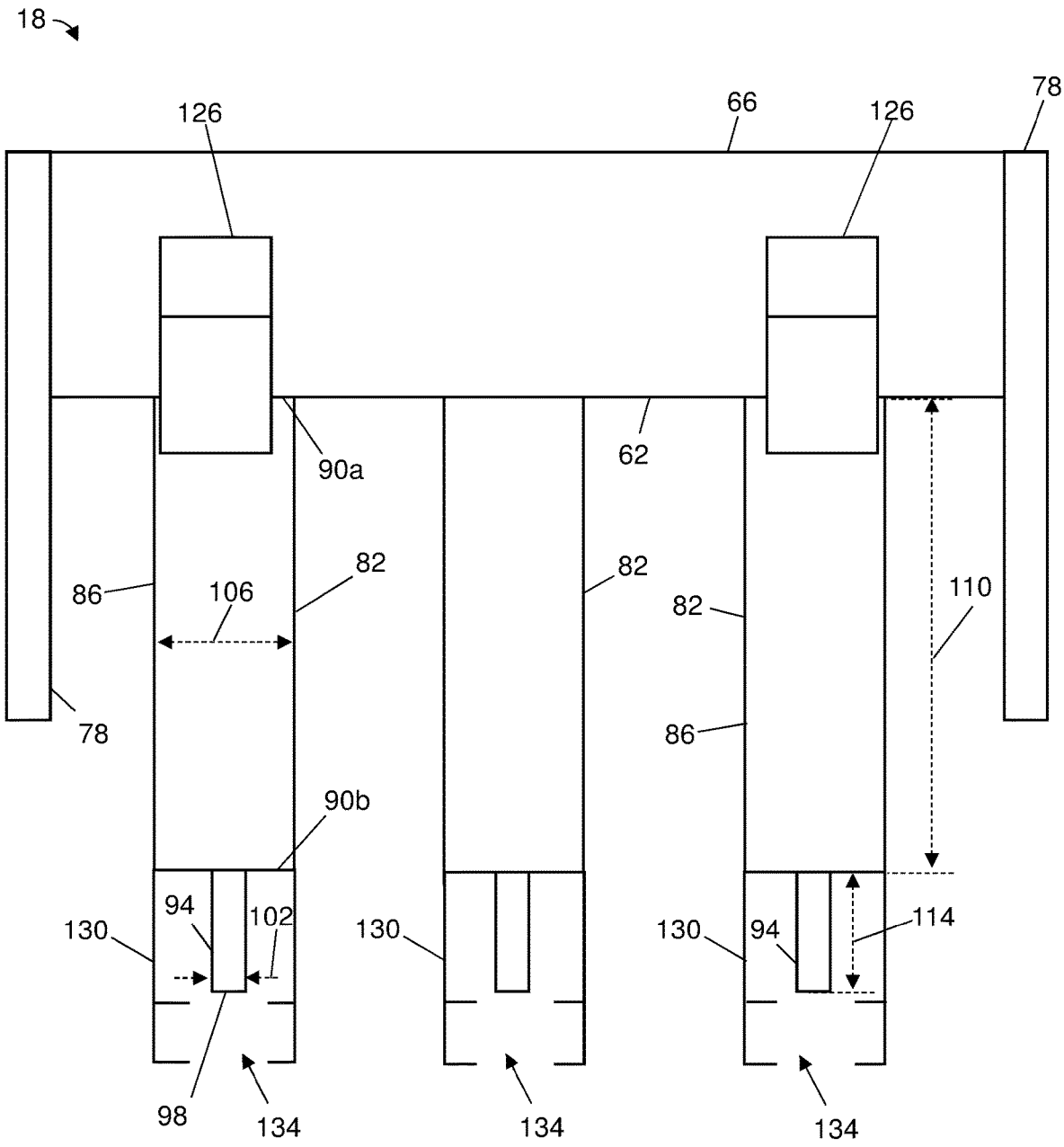
FIG. 3A is a side view of the dispenser tray of the apparatus of FIG. 1A.
Figure 3B:
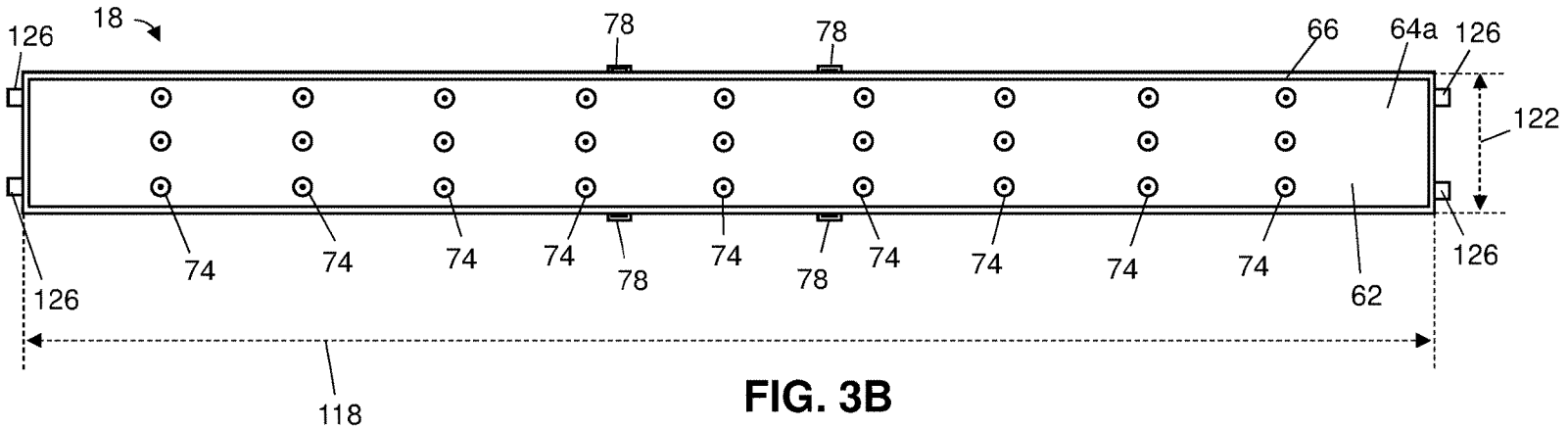
FIGS. 3B and 3C are a top and front views, respectively, of the dispenser tray of FIG. 3A
Figure 3C:
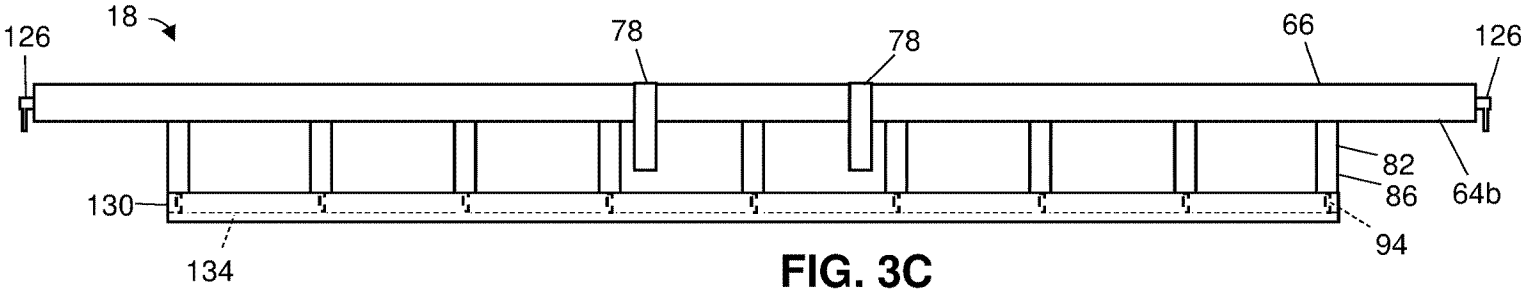

FIGS. 3A-3C show dispenser tray 18 of apparatus 10. Dispenser tray 18 can also comprise a base 62 defining opposing upper and lower surfaces 64*a* and 64*b* and a sidewall 66 that extends away from the upper surface and is disposed along a periphery of the base to define a reservoir 70. Reservoir 70 can collect solution released from solution tray 14 and base 62 can define one or more openings 74 through which that collected solution can flow, such as greater than or equal to any one of, or between any two of, 1, 2, 3, 4, 5, 6, 7, 8, 9, 10, 20, 30, or more openings (e.g., two or more or four or more openings). Sidewall 66 can have any suitable height 68, measured perpendicularly to length 118 and width 122 of dispenser tray 18, for containing an adequate volume of solution, such as a height that is greater than or equal to any one of, or between any two of, 1.0, 1.1, 1.2, 1.3, 1.4, 1.5, 1.6, 1.7, 1.8, 1.9, or 2.0 inches (e.g., between 1.3 and 1.7 inches, or approximately 1.5 inches). Dispenser tray 18 can include one or more slots 78, such as one slot for each of brace(s) 58 of solution tray 14, that are sized and positioned such that each of the brace(s) can be received in a respective one of the slot(s) to couple the trays together (e.g., such that the solution tray rests on top of the dispenser tray). For example, each of slot(s) 78 can be positioned on one of the lengthwise sections of sidewall 66.

Dispenser tray 18 can include one or more dispensers 82, such as greater than or equal to any one of, or between any two of, 1, 2, 3, 4, 5, 6, 7, 8, 9, 10, 20, 30, or more dispensers (e.g., two or more or four or more dispensers); as shown, there are three rows of nine dispensers. Each of dispenser(s) 82 can comprise a tube 86 extending between first and second ends 90*a* and 90*b*, the first end coupled to lower surface 64*a* of base 26 such that the tube can receive solution from one of opening(s) 74. Each of dispenser(s) 82 can also include a flow restrictor 94 that can be coupled to second end 90*b* of tube 86 and define an outlet 98 of the dispenser through which solution can be deposited onto applicator tray 22. Flow restrictor 94 can have a maximum internal transverse dimension 102 that is smaller than a maximum internal transverse dimension 106 of tube 86 to dispense the solution in a controlled manner. To illustrate, transverse dimension 102 of flow restrictor 94 can be less than or equal to any one of, or between any two of, 0.10, 0.09, 0.08, 0.07, 0.06, 0.05, or 0.04 inches (e.g., between 0.04 and 0.08 inches, or approximately 0.0625 inches) and transverse dimension 106 of tube 86 can be greater than or equal to any one of, or between any two of, 0.20, 0.21, 0.22, 0.23, 0.24, 0.25, 0.26, 0.27, 0.28, 0.29, or 0.30 inches (e.g., between 0.22 and 0.28 inches, or approximately 0.25 inches). Each of opening(s) 74 can have substantially the same shape and size as a cross-section of each of tube(s) 86 (e.g., such that a transverse dimension of opening 74 is substantially the same as transverse dimension 106).

Tube(s) 86 and flow restrictor(s) 94 can each have a length suitable to facilitate flow and to contain the volume of solution to be dispensed. For example, each of cylinder(s) 86 can have a length 110, measured between first and second ends 90*a* and 90*b*, that is greater than or equal to any one of, or between any two of, 0.7, 0.8, 0.9, 1.0, 1.1, 1.2, or 1.3 inches (e.g., approximately 1 inch) and each of flow restrictor(s) 94 can have a length, measured between second end 90*b* and outlet 98, that is greater than or equal to any one of, or between any two of, 0.10, 0.15, 0.20, 0.25, 0.30, 0.35, or 0.40 inches (e.g., approximately 0.25 inches).

Dispenser tray 18 can include multiple dispensers 82 positioned in one or more, optionally two or more, sets of dispensers (e.g., one set for each of the absorbent strip(s) to be wetted) such that each of the set(s) is configured to deposit solution onto a respective one of the strip(s). Because the absorbent strip(s) to be wetted can be relatively long (e.g., having a length that is greater than or equal to any one of, or between any two of, 12, 13, 14, 15, 16, 17, 18, 19, 20, 21, 22, 23, or 24 inches) (e.g., such that the strip(s) can cover long but narrow grout and/or caulk lines), for each of the set(s) of dispensers 82, the dispensers can be positioned to deposit the solution onto different locations along the length of the absorbent strip, thereby facilitating a uniform wetting thereof. As shown, dispenser tray 18 includes three sets of nine dispensers 82, each of the sets defining a row of dispensers along length 118 of the dispenser tray such that the dispenser tray is configured to deposit solution onto three absorbent strips. For each of the set(s) of dispensers 82, at least two of the dispensers can be spaced apart by a distance, measured in a direction aligned with length 118 (e.g., in the first direction), that is greater than or equal to any one of, or between any two of, 50%, 60%, 70%, 80%, or 90% of length 118. To accommodate a suitable lengthwise positioning of dispensers 82 and to distribute solution to the dispensers, length 118 of dispenser tray 18 can be relatively long (e.g., relative to length 46 of solution tray 14, whose shorter length may be better suited for accommodating a solution packet). For example, length 118, measured in the first direction, can be greater than or equal any one of, or between any two of, 15, 16, 17, 18, 19, 20, 21, 22, 23, 24, or 25 inches (e.g., approximately 20 inches) and/or length 46 of solution tray 14 can be less than or equal to any one of, or between any two of, 70%, 60%, 50%, 40%, 30%, 20%, or 10% (e.g., less than or equal to 50%, or between 25% and 35%) of the length of the dispenser tray.

Because each of the absorbent strip(s) can be relatively narrow, dispenser tray 18 can have a relatively narrow (relative to its length 118) width 122. For example, width 122 can be less than or equal to any one of, or between any two of, 50%, 40%, 30%, 20%, or 10% (e.g., less than or equal to 30%, or between 5% and 15%) of length 118, such as less than or equal to any one of, or between any two of, 3.0, 2.8, 2.6, 2.4, 2.2, 2.0, 1.8, 1.6, 1.4, or 1.2 inches (e.g., between 1.5 and 2.5 inches, or approximately 2 inches).

Figure 4:
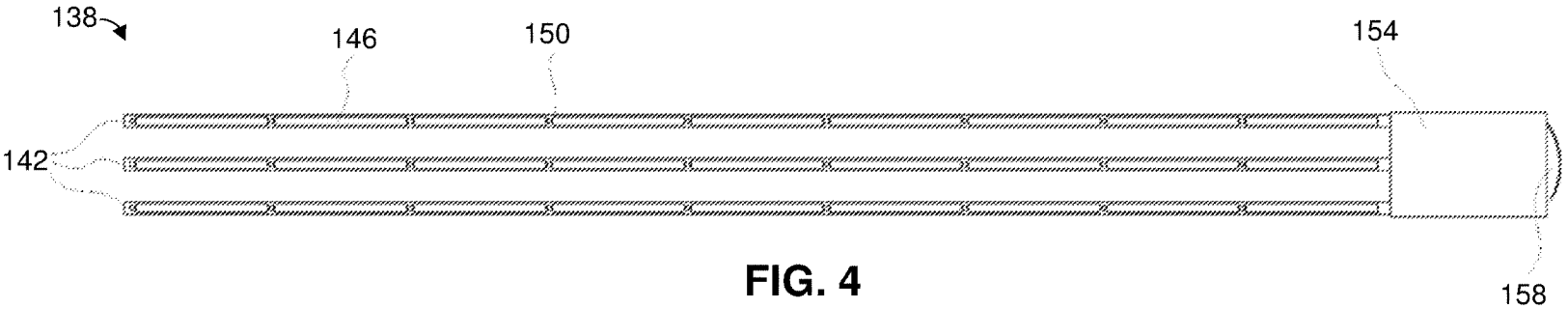
FIG. 4 is a top view of a rail assembly that can be used to selectively block and permit the flow of solution from the dispenser tray of FIG. 3A.

Referring additionally to FIG. 4, apparatus 10 can comprise a rail assembly 138 that comprises one or more dispenser rails 142 configured to selectively permit and block the flow of solution from dispenser(s) 82. Dispenser rail(s) 142 can be slidable between an open position in which solution is permitted to flow from dispenser(s) 82 onto applicator tray 22 and a closed position in which solution is not permitted to flow from the dispenser(s) onto the applicator tray. For example, each of dispenser rail(s) 142 can define one or more openings 146 positioned such that when the sliding dispenser rail is in the open position, each of the opening(s) aligns with one of flow restrictor(s) 94, allowing solution to escape the flow restrictor, pass through the dispenser opening, and fall onto applicator tray 22. Each of opening(s) 146 preferably has a larger cross-sectional area than that of outlet 98 defined by a flow restrictor 94 that overlies the opening when rail 142 is in the open position to allow solution to pass through the dispenser opening unimpeded. As depicted, each of dispenser opening(s) 146 has a rectangular shape, but in other embodiments may have any suitable shape, such as square, oval, or circular. Each of dispenser rail(s) 142 can also include one or more plugs 150 positioned such that when the sliding dispenser rail is in the closed position, each of the plug(s) engages a respective one of flow restrictor(s) 94 to seal outlet 98 defined by the flow restrictor and prevent solution from passing therethrough. For each of dispenser rail(s) 142, each of plug(s) 150 can protrude from a top surface of the dispenser rail and can be spaced apart from one of opening(s) 146 by a distance that is greater than or equal to any one of, or between any two of, 0.10, 0.15, 0.20, 0.25, 0.30, 0.35, or 0.40 inches (e.g., approximately 0.25 inches). In a preferred embodiment, each of plug(s) 150 has a transverse dimension that is substantially the same as the outside transverse diameter of a flow restrictor 94 that the plug is configured to engage and/or the plug comprise rubber material.

When apparatus 10 includes multiples sets of dispensers 82, rail assembly 138 can include multiple dispenser rails 142, one for each of the sets; each of the dispenser rails can define one opening 146 and one plug 150 for each of the dispensers of the set. In the illustrated embodiment, rail assembly 138 includes three dispenser rails 142—one for each of the three rows of dispensers 82—each having nine dispenser openings 146 and nine plugs 150—one for each of the nine dispensers of a row. In a preferred embodiment, dispenser rails 142 are connected to a bar 154 that can comprise pull tab 158 that extends from the bar such that the rails can be slid between the open and closed positions at the same time by pulling or pushing the pull tab.

Dispenser tray 18 can comprise, for each of the sets of dispensers 82, a rail support 130 that is coupled to each of tubes 86 of the set at second end 90*b* and defines a guide 134 configured to receive a respective one of dispenser rails 142 such that the dispenser rail is slidably supported in the guide. Guide 134 can be disposed below outlets 98 defined by flow restrictors 94 of the set.

Figure 5A:
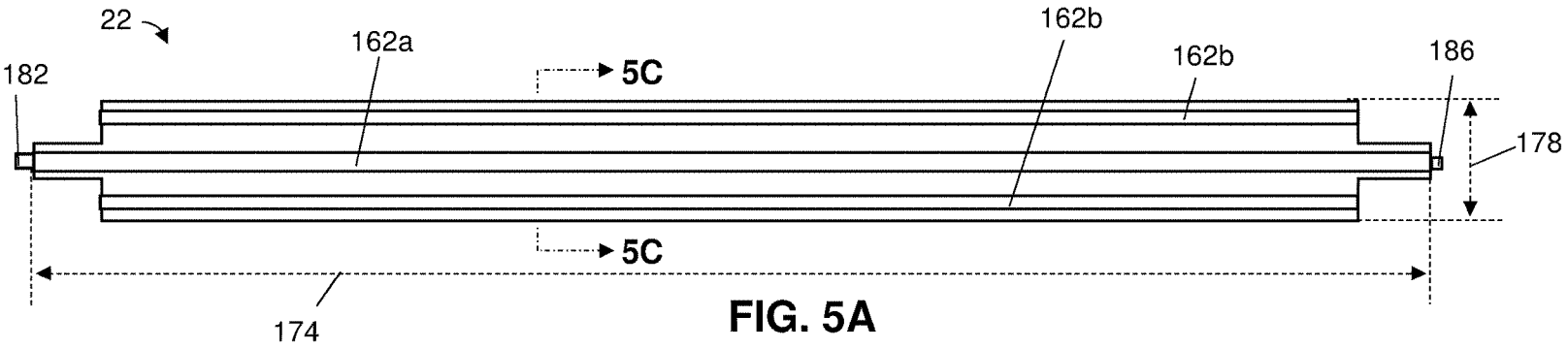
FIGS. 5A and 5B are top and front views, respectively, of the applicator tray of the apparatus of FIG. 1A.
Figure 5B:
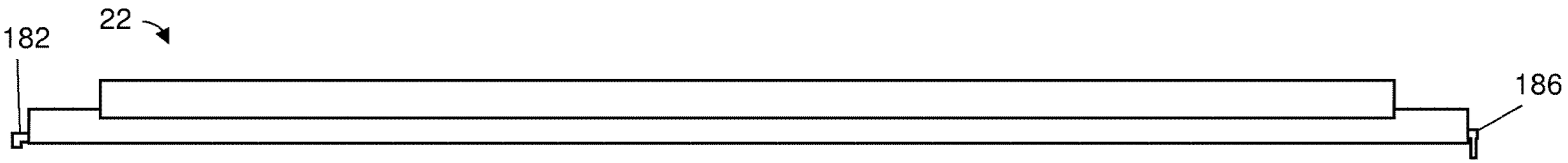
Figure 5C:
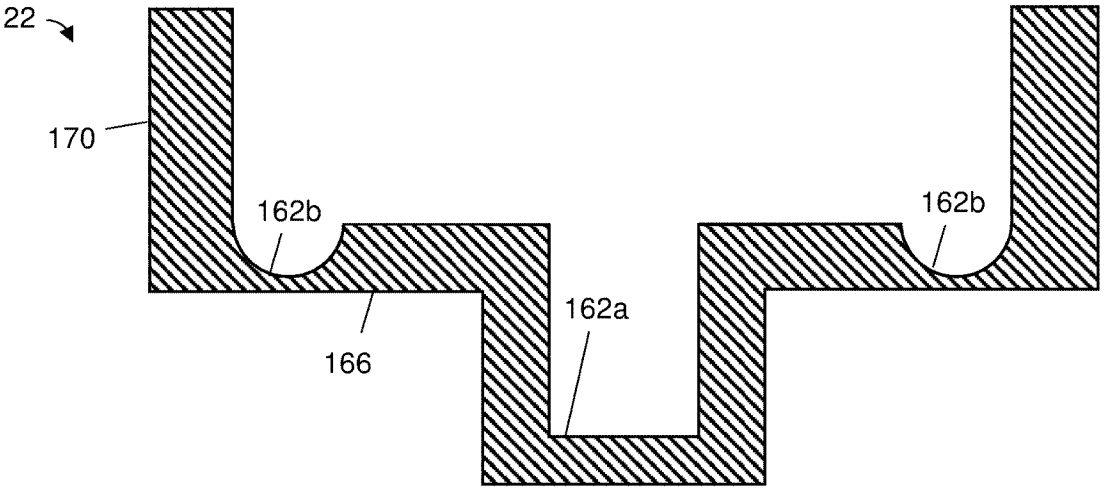
FIG. 5C is a cross-sectional view of the applicator tray of FIG. 5A taken along line 5C-5C.

FIGS. 5A-5C show applicator tray 22 of apparatus 10. Applicator tray 22 can comprise a base 166 and a sidewall 170 disposed along at least a majority of the base, and can be configured to receive one or more absorbent strips, such as greater than or equal to any one of, or between any two of, 1, 2, 3, 4, 5, 6, or 7 absorbent strips. For example, to accommodate relatively long and narrow strip(s), a length 174 (measured in the first direction) and width 178 (measured in the second direction) of applicator tray 22 can be substantially the same as length 118 and width 122, respectively, of dispenser tray 18, such as any of those described above with respect to the dispenser tray. In this manner, dispenser tray 18 and applicator tray 122 can be positioned such that dispenser(s) 82 of the dispenser tray overlie the applicator tray and can deposit solution onto absorbent strip(s) received thereon.

To accommodate multiple absorbent strips, applicator tray 22 can define two or more platforms 162*a* and 162*b*, each extending in a direction aligned with length 174 of applicator tray 22 (e.g., in the first direction) and configured to hold a respective one of the absorbent strips. Platforms 162*a* and 162*b* can be arranged in any suitable manner; for example, those platforms can include one or more lower platforms 162*a* and one or more upper platforms 162*b* that are positioned lower than each of the upper platforms; as shown, applicator tray 22 includes one lower platform 162*a* disposed between two upper platforms 162*b* such that the tray can accommodate three absorbent strips. In other embodiments, however, base 166 of applicator tray 22 need not be divided into upper platform(s) 162*b* and lower platform(s) 162*a* (e.g., such that the base is planar and defines coplanar platforms, whether or not one or more structures segregate those coplanar platforms). For these multi-platform embodiments configured to wet multiple strips, each of the sets of dispensers 82 can be positioned to overlie a respective one of platforms 162*a* and 162*b* such that the set can deposit solution onto an absorbent strip disposed on the platform.

Apparatus 10 can be configured to permit easy assembly and disassembly thereof for storage. For example, apparatus 10 can comprise first and second support frames 190*a* and 190*b*, wherein dispenser tray 18 and/or applicator tray 22 are configured to extend between and be removably coupled to the support frames such that dispenser(s) 82 overlie the applicator tray. As mentioned above, solution tray 14 can be removably coupled to dispenser tray 18 (e.g., via brace(s) 58 and slot(s) 78) and, because it has a length 46 smaller than length 118 of the dispenser tray, need not extend between the support frames. In a preferred embodiment, each of support frames 190*a* and 190*b* has two legs 194 that, optionally, are extendable. When dispenser tray 18 and applicator tray 22 are coupled to support frames 190*a* and 190*b* and solution tray 14 is coupled to the dispenser tray, legs 194 of the frames can be disposed on the ground such that apparatus 10 is freestanding and the solution tray, dispenser tray, and applicator tray are positioned away from the ground.

To promote stability, each of support frames 190*a* and 190*b* can be "A-shaped," with the width of the frame tapering such that a bottom portion is wider than the top portion. Apparatus 10 can also include a stabilizing body 198 that can extend between and be connected to support frames 190*a* and 190*b* to stabilize a bottom portion of apparatus 10; dispenser tray 18 can provide stability for a top portion of the apparatus.

Figure 6:
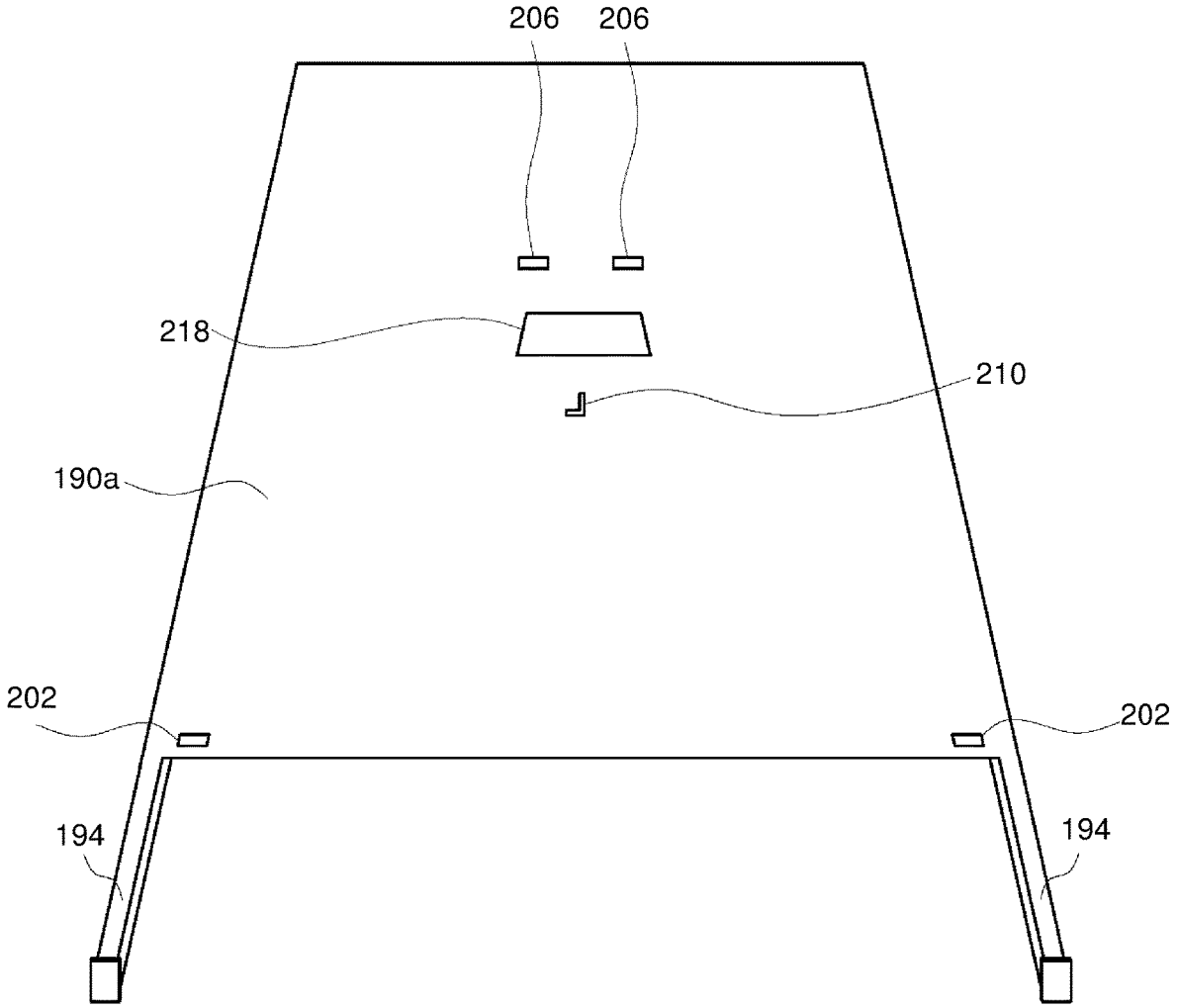
FIG. 6 is a perspective view of one of the support frames of the apparatus of FIG. 1A.

Dispenser tray 18, applicator tray 22, and stabilizing body 198 can be coupled to support frames 190*a* and 190*b* in any suitable manner. For example, dispenser tray 18 can include a plurality of hangers 126 such that each of the widthwise sections of sidewall 66 includes at least one of the hangers protruding therefrom and—referring additional to FIG. 6, which shows first support frame 190*a*—each of support frames 190*a* and 190*b* can have one or more dispenser slots 206, each sized, shaped, and positioned to receive a respective one of dispenser tray's the hangers. First support frame 190*a* can also have a pull tab opening 218 disposed below dispenser slots 206. Pull tab opening 218 can be sized, shaped, and positioned to allow pull tab 158 of rail assembly 138 to extend through the opening when apparatus 10 is assembled and the assembly is coupled to dispenser tray 18 (e.g., via rail support 130, as described above). Pull tab 158 can accordingly be accessed such that it can be pushed to slide dispenser rails 142 into the open position; when in the open position, bar 154 can contact first support frame 190*a* to prevent removal of assembly 138 through pull tab opening 218.

Referring additionally to FIG. 7, applicator tray 22 can be pivotably coupled to second support frame 190*b* such that the applicator tray is pivotable between a first position in which at least a majority of dispenser(s) 82 do not overlie applicator tray 22 (FIG. 7) and a second position in which the dispenser(s) overlie the applicator tray (FIG. 1A). To achieve this pivotable coupling, applicator tray 22 can comprise a hook 182 that protrudes from a widthwise edge of the applicator tray and second support frame 190*b* can have an eye 214 protruding from an inner surface thereof, the eye being sized, shaped, and positioned to receive and support the applicator tray's hook. Hook 182 can be inserted into eye 214 and when the applicator tray 22 pivots from the second position to the first position, the hook can pivot in the eye. Applicator tray 22 can also include a swivel hanger 186 protruding from a widthwise edge of the applicator tray that is opposite the widthwise edge on which hook 182 is disposed. First dispenser support frame 190*a* can have a grommet 210 protruding from an inner surface thereof, the grommet being sized, shaped, and positioned to support swivel hanger 186 of applicator tray 22. By placing swivel hanger 186 into grommet 210, applicator tray 22 can be supported and pivoting thereof can be prevented; the swivel hanger can be configured to be removed from the grommet such that the applicator tray can pivot.

This pivotability of applicator tray 22 may facilitate disposal and removal of absorbent strips. When applicator tray 22 is pivoted open to the first position, one or more absorbent strips can easily be placed thereon. After placing the absorbent strip(s), applicator tray 22 can be swung closed to the second position such that the strip(s) can be wetted and swivel hanger 186 can reengage grommet 210 to secure the applicator tray. After wetting the strip(s), applicator tray 22 can be pivoted open to the first position again such that the strip(s) can easily be removed.

To couple stabilizing body 198 to support frames 190*a* and 190*b*, the stabilizing body can include two or more tabs 222 and each of the supports frames can have one or more floor slots 202, each sized, shaped, and positioned (e.g., below slot(s) 206, pull tab opening 218, and grommet 210 or eye 214) to receive a respective one the stabilizing body's tabs. Stabilizing body 198 can be coupled to support frames 190*a* and 190*b* by inserting its tabs 222 into floor slots 202.

Solution tray 14 (including its lid 38), dispenser tray 18, applicator tray 22, support frames 190*a* and 190*b*, and stabilizing body 198 may be made of an extruded, continuous-cast, or cell-cast polymeric material. In some embodiments, solution tray 14 (including its lid 38), dispenser tray 18, applicator tray 22, support frames 190*a* and 190*b*, and stabilizing body 198 may be produced via injection molding of a polymeric material.

Some of the present methods of wetting one or more absorbent strips comprise assembling an apparatus (e.g., 10) including a solution tray (e.g., 14), a dispenser tray (e.g., 18), and an applicator tray (e.g., 22) (e.g., any of those described above) in any of the ways described above, such as with first and second support frames (e.g., 190*a* and 190*b*) and, optionally, a stabilizing body (e.g., 198). During assembly, the stabilizing body can be coupled to the support frames before the dispenser tray and applicator tray are coupled to the support frames to promote stability. Some methods comprise a step of disposing the absorbent strip(s) on the applicator tray (e.g., after pivoting the applicator tray open to the second position). Each of the strip(s) can comprise any suitable absorbent material, such as cotton, paper, hemp, bamboo, and/or the like, and can have a length that is greater than or equal to any one of, or between any two of, 12, 13, 14, 15, 16, 17, 18, 19, 20, 21, 22, 23, or 24 inches (e.g., approximately 18 inches).

Some methods comprise a step of disposing a solution—which can be a mildew-removing solution—on the solution tray. Suitable mildew-removing solutions include bleach, borax, phenol, sodium phenate, vinegar, ammonia, hydrogen peroxide, detergent, baking soda, or a combination thereof; in a preferred embodiment, the mildew-removing solution comprises bleach. In some methods, disposing the solution comprises disposing a packet that contains the solution onto the solution tray and puncturing the packet (e.g., with one or more spikes 42 of a lid 38 of the solution tray as described above). The packet can comprise, for example, plastic and/or metal foil and can contain greater than or equal to any one of, or between any two of, 2, 3, 4, 5, 6, 7, 8, 9, or 10 fluid ounces (e.g., between 4 and 6 fluid ounces) of solution. The solution can be disposed on the solution tray such that it flows through one or more openings (e.g., 34) defined by the solution tray onto a base (e.g., 62) of the dispenser tray and through one or more, optionally two or more, openings (e.g., 74) defined by the base of the tray into one or more, optionally two or more, dispensers (e.g., 82), each of which can include a tube (e.g., 86) that extends between first and second ends (e.g., 90*a* and 90*b*), the first end coupled to the base of the dispenser tray, and a flow restrictor (e.g., 94) coupled to the second end of the tube and defining an outlet (e.g., 98) of the dispenser. As described above, the flow restrictor can have a maximum internal transverse dimension (e.g., 102) that is less than or equal to 90% (e.g., less than or equal to 40%) of a maximum internal transverse dimension (e.g., 106) of the tube.

Some methods include a step of sliding one or more dispenser rails (e.g., 142) (e.g., any of those described above) from a closed position in which the dispenser rail(s) do not permit fluid to flow from the dispenser(s) onto the applicator tray to an open position such that the solution exits the dispenser(s) and flows onto the absorbent strip(s). By beginning in the closed position, the dispenser rail(s) may allow the solution received by the dispenser tray to accumulate in the dispenser(s). When the dispenser tray includes multiple dispensers, this accumulation allows the dispensers to deposit solution at the same time when the dispenser rail(s) are moved to the open position. Without this accumulation, some dispensers may begin depositing solution before others, which can yield non-uniform wetting of the absorbent strip(s). To ensure solution can accumulate in the dispenser(s), some methods comprising verifying that the dispenser rail(s) are in the closed position (e.g., with each of plugs 150 engaging a respective one of flow restrictors 94).

After the solution drains into the applicator tray and is absorbed by the absorbent strip(s), some methods comprise removing the wetted absorbent strip(s) (e.g., by pivoting the applicator tray open to the second position). The wetted absorbent strip(s) can be disposed on a mildew-affected area, such as on grout and/or caulk lines.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An apparatus for wetting at least one absorbent strip with a solution, the apparatus comprising:

a dispenser tray comprising:

a base that defines opposing upper and lower surfaces and at least one dispenser tray opening;

a sidewall that extends away from the upper surface and is disposed along a periphery of the base; and at least one dispenser, including:

a tube extending between first and second ends, the first end coupled to the base of the dispenser tray such that the tube is configured to receive solution from a respective one of the at least one dispenser tray opening; and a flow restrictor coupled in fixed relation to the second end of the tube and defining an outlet of the dispenser such that solution from the tube is permitted to pass through the flow restrictor to the outlet, the flow restrictor having a maximum internal transverse dimension that is less than or equal to 90% of a maximum internal transverse dimension of the tube;

an applicator tray configured to receive the at least one absorbent strip;

first and second support frames, wherein:

the dispenser tray and the applicator tray are configured to extend between and be removably coupled to the support frames such that the at least one dispenser overlies the applicator tray; and at least one dispenser rail that is slidable between:

an open position in which solution is permitted to flow from the at least one dispenser onto the applicator tray; and a closed position in which solution is not permitted to flow from the at least one dispenser onto the applicator tray;

wherein the applicator tray is configured to be pivotably coupled to the second support frame such that the applicator tray is pivotable between:

a first position in which at least a majority of the at least one dispenser does not overlie the applicator tray; and a second position in which the at least one dispenser overlies the applicator tray;

wherein the dispenser tray and applicator tray are positionable such that when the dispenser tray receives the solution, the solution is permitted to flow:

through the at least one dispenser tray opening into the at least one dispenser; and through the at least one dispenser onto the applicator tray to wet the at least one absorbent strip with the solution when the at least one absorbent strip is on the applicator tray.

2. The apparatus of claim 1 further comprising a solution tray comprising:

a base that defines opposing upper and lower surfaces and at least one solution tray opening; and a sidewall that extends away from the upper surface and is disposed along a periphery of the base;

wherein the solution tray and dispenser tray are positionable such that when the solution tray receives the solution, the solution is permitted to flow through the at least one solution tray opening onto the base of the dispenser tray.

3. The apparatus of claim 2, wherein the solution tray comprises a lid that:

is movable between an open position and a closed position in which the lid overlies at least a majority of the base of the solution tray; and comprises at least one spike configured to puncture a packet that is disposed on the solution tray when the lid is moved to the closed position.

4. The apparatus of claim 1, wherein the at least one dispenser rail comprises:

at least one plug positioned such that, when the at least one dispenser rail is in the closed position, each of the at least one plug engages the outlet of a respective one of the at least one dispenser to seal the outlet; and at least one dispenser rail opening positioned such that, when the at least one dispenser rail is in the open position, for each of the at least one dispenser rail opening solution from a respective one of the at least one dispenser is permitted to pass through the dispenser rail opening.

5. The apparatus of claim 1, wherein for each of the at least one dispenser a maximum internal transverse dimension of the flow restrictor is less than or equal to 40% of a maximum internal transverse dimension of the tube.

6. The apparatus of claim 5, wherein for each of the at least one dispenser a maximum internal transverse dimension of the flow restrictor is less than or equal to 0.10 inches.

7. The apparatus of claim 2, wherein:

each of the solution tray, the dispenser tray, and the applicator tray has:

a length measured in a first direction; and a width measured in a second direction that is perpendicular to the first direction;

for each of the dispenser tray and the applicator tray, the width of the tray is less than or equal to 30% of the length of the tray; and the length of the solution tray is less than or equal to 50% of each of the lengths of the dispenser tray and the applicator tray.

8. An apparatus for wetting at least one absorbent strip with a solution, the apparatus comprising:

a dispenser tray comprising:

a base that defines opposing upper and lower surfaces and at least one dispenser tray opening;

a sidewall that extends away from the upper surface and is disposed along a periphery of the base; and at least four dispensers, including:

a tube extending between first and second ends, the first end coupled to the base of the dispenser tray such that the tube is configured to receive solution from a respective one of the at least one dispenser tray opening; and a flow restrictor coupled in fixed relation to the second end of the tube and defining an outlet of the dispenser such that solution from the tube is permitted to pass through the flow restrictor to the outlet, the flow restrictor having a maximum internal transverse dimension that is less than or equal to 90% of a maximum internal transverse dimension of the tube;

an applicator tray configured to receive the at least one absorbent strip, wherein the applicator tray comprises at least two platforms; the dispensers are positioned in two or more sets of two or more dispensers, each of the sets configured to overlie a respective one of the platforms;

first and second support frames, wherein:

the dispenser tray and the applicator tray are configured to extend between and be removably coupled to the support frames such that the at least one dispenser overlies the applicator tray; and comprising at least one dispenser rail that is slidable between:

an open position in which solution is permitted to flow from the at least one dispenser onto the applicator tray; and a closed position in which solution is not permitted to flow from the at least one dispenser onto the applicator tray;

wherein the dispenser tray and applicator tray are positionable such that when the dispenser tray receives the solution, the solution is permitted to flow:

through the at least one dispenser tray opening into the at least one dispenser; and through the at least one dispenser onto the applicator tray to wet the at least one absorbent strip with the solution when the at least one absorbent strip is on the applicator tray.

9. The apparatus of claim 8, wherein the at least two platforms include at least one upper platform and at least one lower platform, the at least one lower platform being positioned lower than each of the at least one upper platform.

10. The apparatus of claim 8, wherein:

the dispenser tray has a length measured in a first direction and a width measured in a second direction that is perpendicular to the first direction that is less than or equal to 30% of the length; and for each of the sets of dispensers, at least two of the dispensers are separated by a distance, measured in the first direction, that is greater than or equal to 50% of the length of the dispenser tray.

11. The apparatus of claim 8, comprising for each of the sets of dispensers, a rail support that:

is coupled to dispensers of the set; and defines a guide that is disposed below the flow restrictors of the set and is configured to receive a respective one of the dispenser rails.

* * * * *